US009664438B2

(12) United States Patent
Park

(10) Patent No.: US 9,664,438 B2
(45) **Date of Patent: *May 30, 2017**

(54) SWITCH MODULE AND REFRIGERATOR HAVING THE SAME

(71) Applicant: SAMSUNG ELECTRONICS CO., LTD., Suwon-si (KR)

(72) Inventor: Sung Cheul Park, Sinchang-dong (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/874,658

(22) Filed: Oct. 5, 2015

(65) Prior Publication Data

US 2016/0025407 A1 Jan. 28, 2016

Related U.S. Application Data

(63) Continuation of application No. 13/052,671, filed on Mar. 21, 2011, now Pat. No. 9,182,167.

(30) Foreign Application Priority Data

Apr. 27, 2010 (KR) ..... 10-2010-0038988

(51) Int. Cl.
*F25D 3/00* (2006.01)
*F25D 23/12* (2006.01)
(Continued)

(52) U.S. Cl.
CPC ..... *F25D 23/126* (2013.01); *F25D 23/028* (2013.01); *H01H 3/122* (2013.01); *F25D 2327/001* (2013.01)

(58) Field of Classification Search
CPC ..... F25D 2327/001; F25D 23/126; F25D 23/028; H01H 3/122; H01H 3/12; H01H 3/20; H01H 3/22; F25B 7/00; F25B 1/005
See application file for complete search history.

(56) References Cited

U.S. PATENT DOCUMENTS 2,437,299 A 3/1948 Jacobi
3,934,757 A 1/1976 Malek et al.
(Continued)

FOREIGN PATENT DOCUMENTS

JP 2007-258063 10/2007
KR 20-1998-0068435 12/1998
(Continued)

OTHER PUBLICATIONS

Korean Office Action dated Aug. 14, 2014 in corresponding Korean Application No. 10-2010-0038988.
(Continued)

*Primary Examiner* — Len Tran
*Assistant Examiner* — Ana Vazquez
(74) *Attorney, Agent, or Firm* — Staas & Halsey LLP

(57) ABSTRACT

Disclosed herein are a switch module and a refrigerator having the same. The refrigerator includes with a dispenser installed on a door and a switch module to operate the dispenser. The switch module includes a push button having a front surface thereof disposed in a vertical direction and moving forwards and backwards by external force, and a link assembly allowing an upper portion and a lower portion of the push button to simultaneously move forwards and backwards while maintaining the front surface of the push button to be in a vertical direction during the forward and backward movement of the push button.

15 Claims, 6 Drawing Sheets

(51) Int. Cl.
*H01H 3/12* (2006.01)
*F25D 23/02* (2006.01)

(56) References Cited

U.S. PATENT DOCUMENTS

| | | | | |
|---|---|---|---|---|
| 4,167,280 | A | 9/1979 | Godec et al. | |
| 4,545,606 | A | 10/1985 | Vodra | |
| 5,803,240 | A | 9/1998 | Swidersky et al. | |
| 6,267,272 | B1 | 7/2001 | Shin | |
| 6,899,362 | B1 | 5/2005 | Weinerman et al. | |
| 7,040,110 | B2 | 5/2006 | Nowak | |
| 7,188,487 | B2 | 3/2007 | Choi | |
| 7,347,460 | B2 | 3/2008 | Ala | |
| 7,415,834 | B2 | 8/2008 | Marret et al. | |
| 8,184,021 | B2 | 5/2012 | Chou | |
| 2005/0152102 | A1 | 7/2005 | Shin | |
| 2005/0224329 | A1 | 10/2005 | Milo | |
| 2006/0000694 | A1 | 1/2006 | Nishino et al. | |
| 2006/0203485 | A1* | 9/2006 | Fu | H01H 13/83 362/237 |
| 2007/0127229 | A1 | 6/2007 | Lee et al. | |
| 2008/0202147 | A1 | 8/2008 | Lim et al. | |
| 2009/0056363 | A1 | 3/2009 | Lee | |
| 2010/0199704 | A1* | 8/2010 | Koo | F25D 23/126 62/389 |

FOREIGN PATENT DOCUMENTS

| | | | |
|---|---|---|---|
| KR | 10-2006-0062146 | | 6/2006 |
| KR | 10-0620370 | | 9/2006 |
| KR | 10-2007-0077918 | | 7/2007 |
| KR | 10-0766119 | | 10/2007 |
| KR | 10-2009-0036721 | A | 4/2009 |
| KR | 10-2009-0038728 | | 4/2009 |
| KR | 10-2009-0050830 | | 5/2009 |
| KR | 10-2009-0106933 | A | 10/2009 |
| KR | 10-2009-0113470 | A | 11/2009 |
| KR | 10-2009-0120107 | | 11/2009 |

OTHER PUBLICATIONS

U.S. Office Action dated May 3, 2013 in co-pending U.S. Appl. No. 13/052,671.

U.S. Final Office Action dated Oct. 9, 2013 in co-pending U.S. Appl. No. 13/052,671.

U.S. Office Action dated Apr. 24, 2014 in co-pending U.S. Appl. No. 13/052,671.

U.S. Final Office Action dated Dec. 19, 2014 in co-pending U.S. Appl. No. 13/052,671.

U.S. Notice of Allowance dated Jul. 13, 2015 in co-pending U.S. Appl. No. 13/052,671.

U.S. Appl. No. 13/052,671, filed Mar. 21, 2011, Sung Cheul Park, Samsung Electronics Co., Ltd.

Office Action mailed Jan. 27, 2016 in Korea Patent Application No. 10-2015-0071031.

Extended European Search Report mailed Feb. 3, 2016 in European Patent Application No. 11159488.3.

Korean Office Action issued on Apr. 29, 2016 in Korean Application No. 10-2015-0071031.

Korean Office Action dated Sep. 30, 2016 in corresponding Korean Patent Application No. 10-2015-0071031.

European Office Action dated Nov. 18, 2016 in corresponding European Patent Application No. 11 159 488.3.

* cited by examiner

SWITCH MODULE AND REFRIGERATOR HAVING THE SAME

CROSS-REFERENCE TO RELATED APPLICATION

This is a continuation application of application U.S. Ser. No. 13/052,671 filed in the United States on Mar. 21, 2011, and is related to and claims priority benefit to Korean Patent Application No. 10-2010-0038988, filed on Apr. 27, 2010 in the Korean Intellectual Property Office, the disclosures of which are incorporated herein by reference.

BACKGROUND

1. Field

Embodiments relate to a refrigerator in which a dispenser to supply water or ice is installed on a door.

2. Description of the Related Art

In general, a refrigerator is an apparatus which includes components of a refrigerating cycle so as to store articles in a frozen state or a refrigerated state using cool air generated from an evaporator of the refrigerating cycle.

Such a refrigerator includes a main body provided with a storage chamber to store articles, such as food, and doors to open and close the storage chamber, and an ice maker to manufacture ice is installed in the storage chamber and a dispenser to dispense the ice manufactured by the ice maker without opening the doors is installed on any one door of the doors, thereby allowing the ice stored in the storage chamber to be directly dispensed by operating the dispenser from the outside.

SUMMARY

Therefore, it is an aspect to provide a switch module to more stably operate a dispenser and a refrigerator having the same.

Additional aspects will be set forth in part in the description which follows and, in part, will be obvious from the description, or may be learned by practice of the embodiments.

In accordance with one aspect of the embodiments, a refrigerator includes a main body provided with a storage chamber, doors to open and close the storage chamber, a dispenser installed on any one doors of the door, and a switch module to operate the dispenser, wherein the switch module includes a switch to operate the dispenser, a push button moving backwards by external force and applying pressure to the switch to operate the switch, and a link assembly rotatably installed on the rear surface of the push button to simultaneously move the upper and lower portions of the push button forwards and backwards.

The push button may include a pressure part protruding backwardly from the rear surface of the push button, and the switch may include a switching protrusion protruding forwardly such that pressure is applied to the switching protrusion by the pressure part.

The link assembly may include an upper link provided with the front end rotatably installed on the upper portion of the rear surface of the push button, a lower link provided with the front end rotatably installed on the lower portion of the rear surface of the push button, and an interlock link provided with the upper end rotatably installed on the rear end of the upper link and the lower end rotatably installed on the rear end of the lower link.

The upper link may include a pair of upper link parts provided with the front ends rotatably installed at both sides of the upper portion of the rear surface of the push button and an upper connection shaft interconnecting the pair of upper link parts, the lower link may include a pair of lower link parts provided with the front ends rotatably installed at both sides of the lower portion of the rear surface of the push button and a lower connection shaft interconnecting the pair of lower link parts, and the interlock link may include a pair of interlock link parts provided with the upper ends rotatably installed on the rear ends of the two upper link parts and the lower ends rotatably installed on the rear ends of the two lower link parts and an interlock connection shaft interconnecting the pair of the interlock link parts.

The switch module may further include a restoring spring to elastically support the push button forwards.

The switch module may further include first buffering members to elastically support the rear surface of the push button moved backwards.

The switch module may further include second buffering members installed opposite to the upper ends of the interlock link parts to elastically support the upper end of the interlock link moved upwards.

The switch module may further include a pair of light sources to inclinedly irradiate light towards both sides in the forward direction.

The push button may include a transparent member made of a transparent material to transmit the light irradiated from the light sources, and an opaque member made of an opaque material and covering the front surface of the transparent member.

The switch module may further include a switch case provided with the front surface on which the push button is arranged and receiving the switch therein, the dispenser may include a dispenser case provided with a discharge part formed at the lower portion thereof, and the switch case may be arranged on the rear surface of the discharge part.

The switch case may be formed integrally with the discharge part.

The switch module may further include a switch case provided with the front surface on which the push button is arranged and receiving the switch therein, the door may include a discharge part formed by depressing a part of the front surface thereof, and the switch case may be arranged on the front surface of the door forming the discharge part.

The switch case may be formed integrally with the front surface of the door.

In accordance with another aspect of the embodiments, a switch module includes a switch, a push button moving backwards by external force and applying pressure to the switch to operate the switch, a link assembly rotatably installed on the rear surface of the push button to simultaneously move the upper and lower portions of the push button forwards and backwards, and a restoring spring to elastically support the push button forwards.

In accordance with a further aspect of the embodiments, a switch module includes a switch, a push button moving backwards by external force and applying pressure to the switch to operate the switch, sources arranged in the rear of the push button to irradiate light to the push button, and a link assembly rotatably installed on the rear surface of the push button to simultaneously move the upper and lower portions of the push button forwards and backwards.

BRIEF DESCRIPTION OF THE DRAWINGS

These and/or other aspects of the embodiments will become apparent and more readily appreciated from the following description of the embodiments, taken in conjunction with the accompanying drawings of which.

DETAILED DESCRIPTION

Figure 1:
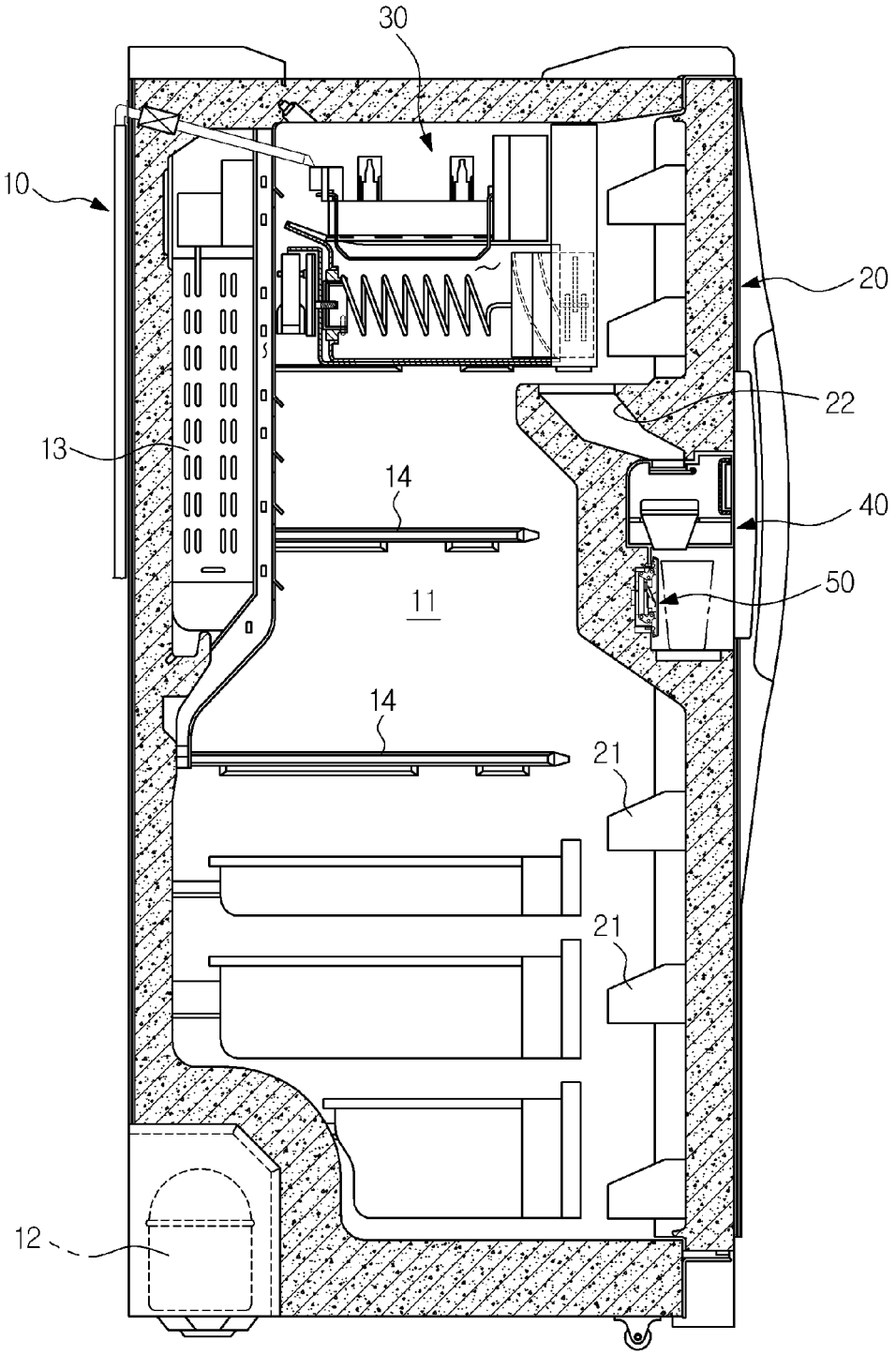
FIG. 1 is a longitudinal-sectional view of a refrigerator in accordance with one embodiment.

Reference will now be made in detail to the embodiments, examples of which are illustrated in the accompanying drawings, wherein like reference numerals refer to like elements throughout.

As shown in FIG. 1, a refrigerator in accordance with one embodiment includes a main body 10 forming an external appearance of the refrigerator and provided with a storage chamber 11 formed therein to store articles, and doors 20 provided with side ends respectively hinged to the main body 10 and rotated to open and close the storage chamber 11. In this embodiment, the storage chamber 11 is horizontally divided into a refrigerating chamber (not shown) to store articles in a refrigerated state and a freezing chamber to store articles in a frozen state, and a pair of the doors 20 is provided to respectively open and close the refrigerating chamber and the freezing chamber divided from the storage chamber 11.

Components of a refrigerating cycle, i.e. a compressor 12 to compress a refrigerant, a condenser (not shown) to cool the refrigerant through heat exchange of the refrigerant with air at the outside of the main body 10, an expansion valve (not shown) to decompress and expand the refrigerant, and an evaporator 13 disposed at the rear portion of the storage chamber 11 to generate cool air through absorption of heat from air at the inside of the storage chamber 11, are installed in the main body 10. The articles stored in the storage chamber 11 are maintained at a low temperature by the cool air generated from the evaporator 13.

An ice maker 30 to manufacture ice is installed in the upper portion of the storage chamber 11, and the inside of the storage chamber 11 is vertically divided by plural racks 14 so as to efficiently store multiple articles. A dispenser 40 to dispense ice manufactured by and stored in the ice maker 30 without opening the doors 20 is installed on one door 20, and an ice guide hole 22 to guide the ice from the ice maker 30 to the dispenser 40 is provided on the door 20. Further, door racks 21 to store articles, such as drinks, are disposed on the inner surfaces of the doors 20.

Figure 2:
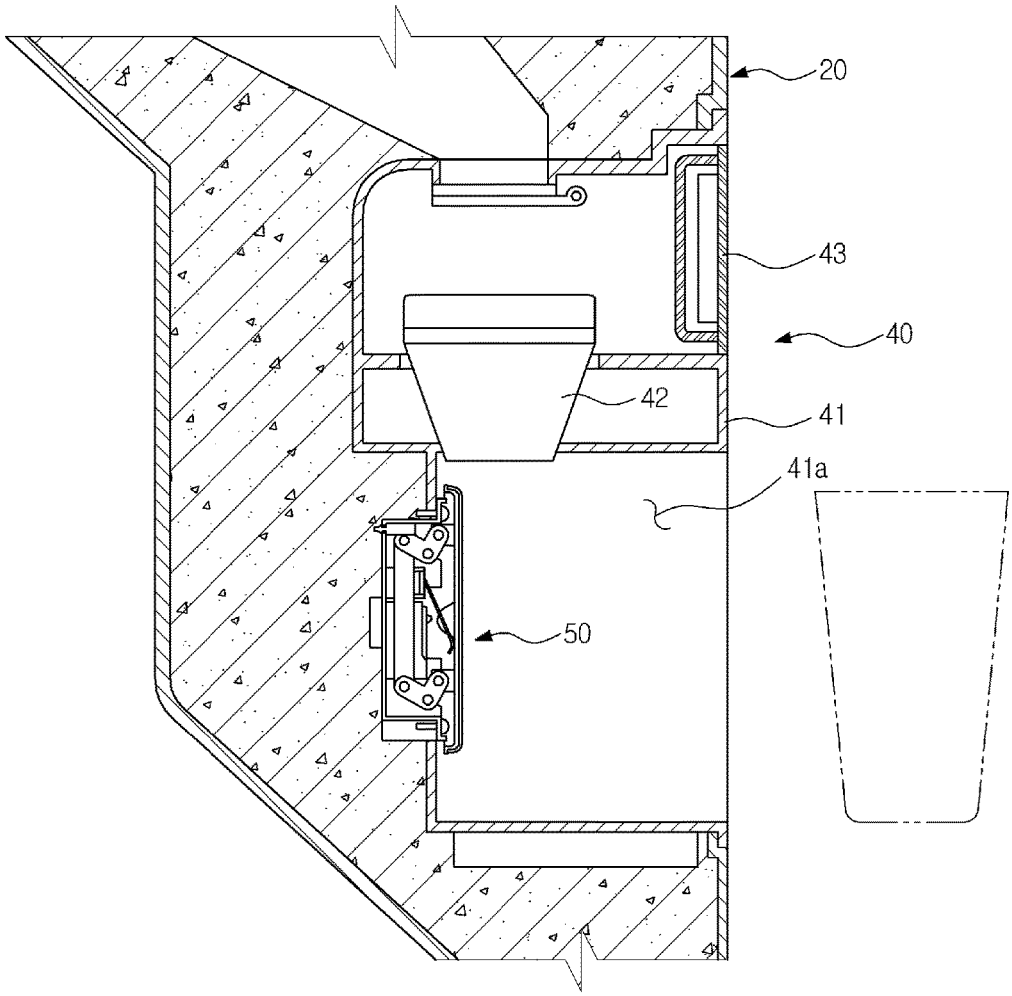
FIG. 2 is a longitudinal-sectional view of a dispenser applied to the refrigerator in accordance with the embodiment.

The dispenser 40 includes a dispenser case 41 (see FIG. 2) provided with a discharge part 41*a* formed in the lower portion thereof and depressed backwardly from the front surface of the door 20. A control panel 43 including a display to display operating states of the refrigerator and the dispenser 40 and buttons to select operations of the refrigerator and the dispenser 40 is arranged above the dispenser case 41.

An ice discharge pipe 42 to discharge ice from the ice maker 30 is provided above the discharge part 41*a*, and a switch module 50 to operate the dispenser 40 is installed on the rear portion of the discharge part 41*a*.

Figure 3:
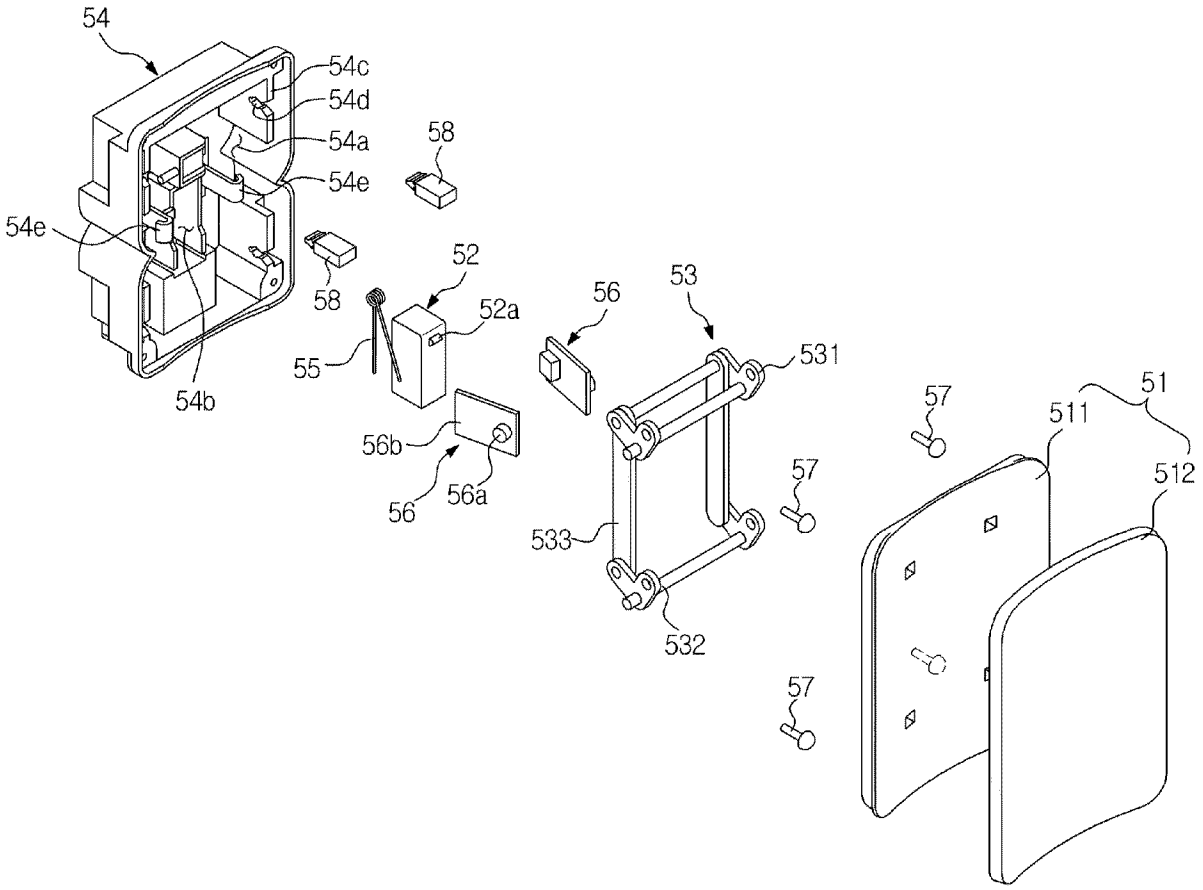
FIGS. 3 and 4 are exploded perspective views of a switch module applied to the refrigerator in accordance with the embodiment.
Figure 4:
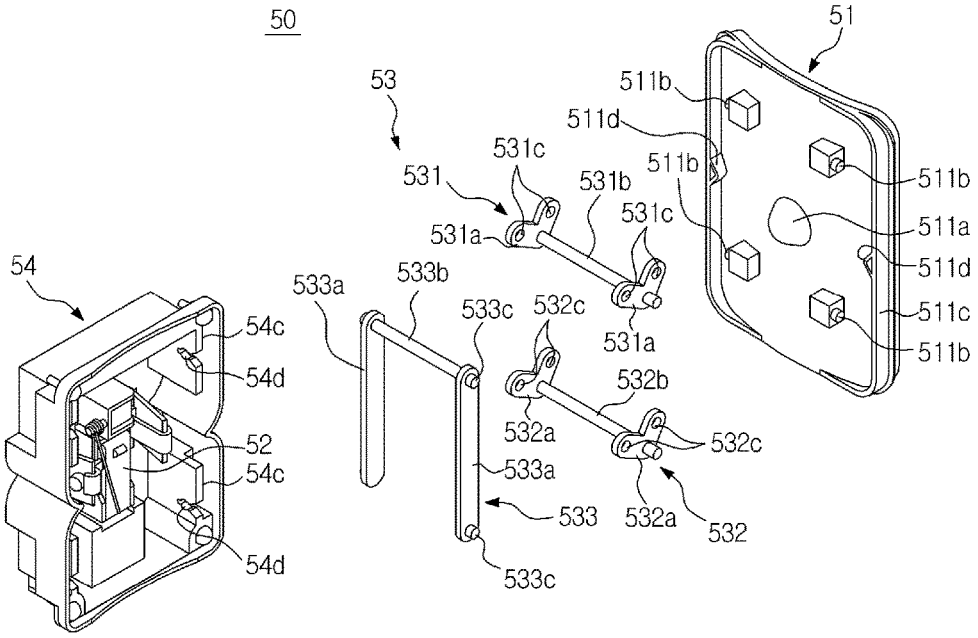

The switch module 50, as shown in FIGS. 3 and 4, includes a push button 51 installed so as to be movable forwards and backwards by external force, a switch 52 arranged in the rear of the push button 51 and pressed by the push button 51 moved backwards, a switch case 54 provided with an opened front surface portion covered with the push button 51 to receive internal components, such as the switch 52, and a restoring spring 55 elastically supporting the push button 51 forwards. The push button 51 is installed on the switch case 54 by a link assembly 53 including a plurality of links such that the push button 51 may move forwards and backwards and be rotated.

The push button 51 includes a pressure part 511*a* protruding backwardly from the rear surface of the push button 51, and the switch 52 includes a switching protrusion 52*a* protruding forwardly such that pressure is applied to the switching protrusion 52*a* by the pressure part 511*a* of the push button 51 moved backwards.

The switch case 54 is arranged on the rear surface of the discharge part 41*a* of the dispenser case 41. The switch case 54 is provided with a receipt space 54*a* opening forwards so as to receive internal components of the switch module 50, such as the switch 52, and a switch installation part 54*b* in which the switch 52 is installed is provided at the center of the receipt space 54*a*.

First buffering members 57 to elastically support the rear surface of the push button 51 moved backwards by external force are installed at corners of the switch case 54. In this embodiment, the switch case 54 is formed in an about rectangular parallelepiped shape, and four first buffering members 57 are respectively installed at four corners of the switch case 54. Therefore, when the push button 51 moves backwards, the first buttering members 57 prevent collision of the push button 51 with the switch case 54.

The restoring spring 55 is a torsion spring provided with one end supported by the switch case 54 and the other end supported by the rear surface of the push button 51. The restoring spring 55 is elastically deformed when the push button 51 moves backwards by external force, and the restoring spring 55 is elastically restored to its original state when the external force is released and, thus, the push button 51 moves forwards by the elastic restoring force of the restoring spring 55.

The link assembly 53 enables the upper and lower portions of the push button 51 to be interlocked with each other and thus to simultaneously move forwards and backwards. The link assembly 53 includes an upper link 531 provided with the front end rotatably installed on the upper portion of the rear surface of the push button 51, a lower link 532 provided with the front end rotatably installed on the lower portion of the rear surface of the push button 51, and an interlock link 533 provided with the upper end rotatably installed on the rear end of the upper link 531 and the lower end rotatably installed on the rear end of the lower link 532.

The upper link 531 includes a pair of upper link parts 531*a* provided with the front ends rotatably installed at both sides of the upper portion of the rear surface of the push button 51, and an upper connection shaft 531*b* interconnecting the pair of upper link parts 531*a*. The lower link 532 includes a pair of lower link parts 532*a* provided with the front ends rotatably installed at both sides of the lower portion of the rear surface of the push button 51, and a lower connection shaft 532*b* interconnecting the pair of lower link parts 532*a*. Further, the interlock link 533 includes a pair of interlock link parts 533*a* provided with the upper ends rotatably installed on the rear ends of the two upper link parts 531*a* and the lower ends rotatably installed on the rear ends of the two lower link parts 532*a*, and an interlock connection shaft 533*b* interconnecting the pair of the interlock link parts 533*a*.

A pair of first hinge holes 531*c* is provided at both ends of each of the upper link parts 531*a* so as to enable the upper link parts 531*a* to be rotatably installed on the push button 51 and the interlock link 533, respectively. Further, a pair of second hinge holes 532*c* is provided at both ends of each of the lower link parts 532*a* so as to enable the lower link parts 532*a* to be rotatably installed on the push button 51 and the interlock link 533, respectively.

Four hinge protrusions 511*b* fitted into the first hinge holes 531*c* provided at the front ends of the two upper link parts 531*a* and the second hinge holes 532*c* provided at the front ends of the two lower link parts 532*a* are formed on the upper and lower portions of the rear surface of the push button 51, and two pairs of second hinge protrusions 533*c* fitted into the first hinge holes 531*c* provided at the rear ends of the two upper link parts 531*a* and the second hinge holes 532*c* provided at the rear ends of the two lower link parts 532*a* are formed at the upper ends and the lower ends of the two interlock link parts 533*a*.

Here, the two upper link parts 531*a* are formed in a V shape, respectively, and both ends of the upper connection shaft 531*b* are connected to the centers of the two upper link parts 531*a* to interconnect the two upper link parts 531*a*. Further, the two lower link parts 532*a* are formed in a V shape, respectively, and both ends of the lower connection shaft 532*b* are connected to the centers of the two lower link parts 532*a* to interconnect the two lower link parts 532*a*.

When the push button 51 is installed on the switch case 54 through the above-described link assembly 53, four places of the push button 51 are operated under the condition that they are interlocked with each other through the link assembly 53. Therefore, external force applied to the push button 51 is dispersed through the link assembly 53, and thereby the push button 51 performs the uniform operation regardless of a position to which external force is applied.

Further, a pair of second buffering members 58 opposite to the upper ends of the two interlock link parts 533*a* to prevent collision of the two interlock link parts 533*a* with the inner surface of the switch case 54 is installed in the switch case 54. The second buffering members 58 prevent generation of noise due to collision of the upper ends of the interlock link parts 533*a* with the inner surface of the switch case 54 caused by upward movement of the upper ends of the interlock link parts 533*a* during forward movement of the push button 51 by the elastic restoring force of the restoring spring 55.

The above link assembly 53 is separably installed in the switch case 54, thereby allowing the internal components of the switch module 50 installed in the receipt space 54*a* to be easily repaired. For this purpose, hinge grooves 54*d* through which the link assembly 53 is rotatably and separably installed in the switch case 54 are provided on the switch case 54.

In this embodiment, both ends of the upper connection shaft 531*b* and both ends of the lower connection shaft 532*b* are rotatably and separably installed in the hinge grooves 54*d*, respectively. Four hinge parts 54*c*, each of which is provided with the hinge groove 54*d*, to install both sides of the upper connection shaft 531*b* and both sides of the lower connection shaft 532*b* therein are formed at both sides of the upper and lower portions of the switch case 54, and thus four hinge grooves 54*d* are provided. A width of an inlet part of the hinge groove 54*d* is smaller than a width of the inside of the hinge groove 54*d*, and thus the installed state of the upper connection shaft 531*b* and the lower connection shaft 532*b* in the hinge grooves 54*d* is maintained unless force of a designated degree or more is applied to the push button 51.

In order to achieve a decorative effect, the switch module 50 includes light sources 56 installed in the switch case 54 to irradiate light toward the push button 51. In this embodiment, the light source 56 includes a light emitting diode 56*a*, and a substrate 56*b* on which the light emitting diode 56*a* is installed. Further, a pair of light sources 56 is arranged in the rear of the push button 51 so as to irradiate light towards both sides of the push button 51. One light source 56 of the two light sources 56 is inclined to one side in the forward direction, and the other light source 56 of the two light sources 56 is inclined to the other side in the forward direction.

Light source installation parts 54*e* are provided at both sides of the switch installation part 54*b* in the receipt space 54*a* of the switch case 54. The light source installation parts 54*e* are inclined such that the two light sources 65 are respectively installed in the light source installation parts 54*e*.

Light generated from the light sources 56 passes through the side surfaces of the push button 51, and is irradiated towards the discharge part 41*a*. For this purpose, the push button 51 includes a transparent member 511 made of a transparent or semitransparent material, and an opaque member 512 made of an opaque material and covering the front surface of the transparent member 511.

Rib parts 511*c* protruded backwardly along the edge of the transparent member 511 are provided at both sides of the transparent member 511, and a dispersion part 511*d* to disperse the light irradiated from the light source 56 in the vertical direction is provided at the center of each of the rib part 511*c*, i.e., at a position corresponding to the light source 56. In this embodiment, the dispersion parts 511*d* are formed integrally with the rib parts 511*c*, and one vertex of each of the dispersion parts 511*d* is formed in a triangular shape corresponding to the light source 56.

Hereinafter, operation of the above switch module of the refrigerator in accordance with the embodiment will be described with reference to the accompanying drawings.

Figure 5:
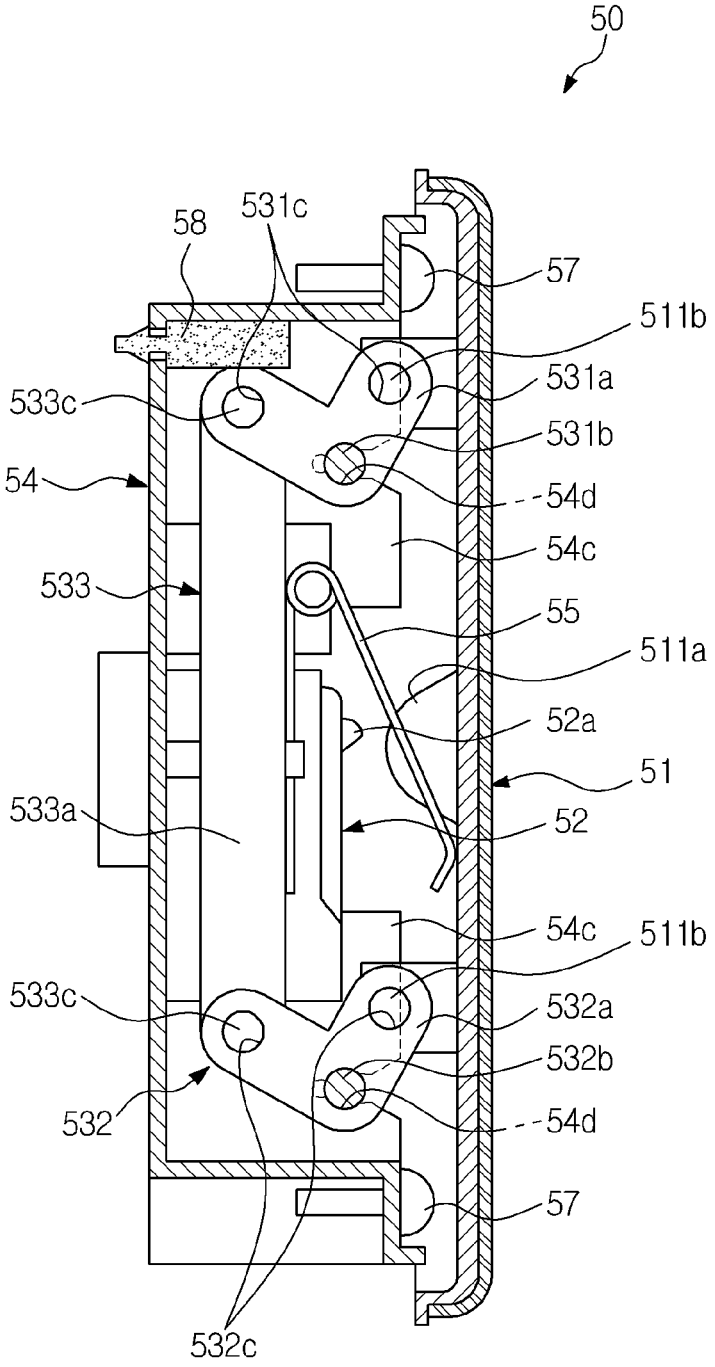
FIGS. 5 and 6 are longitudinal-sectional views illustrating operation of the switch module applied to the refrigerator in accordance with the embodiment.
Figure 6:
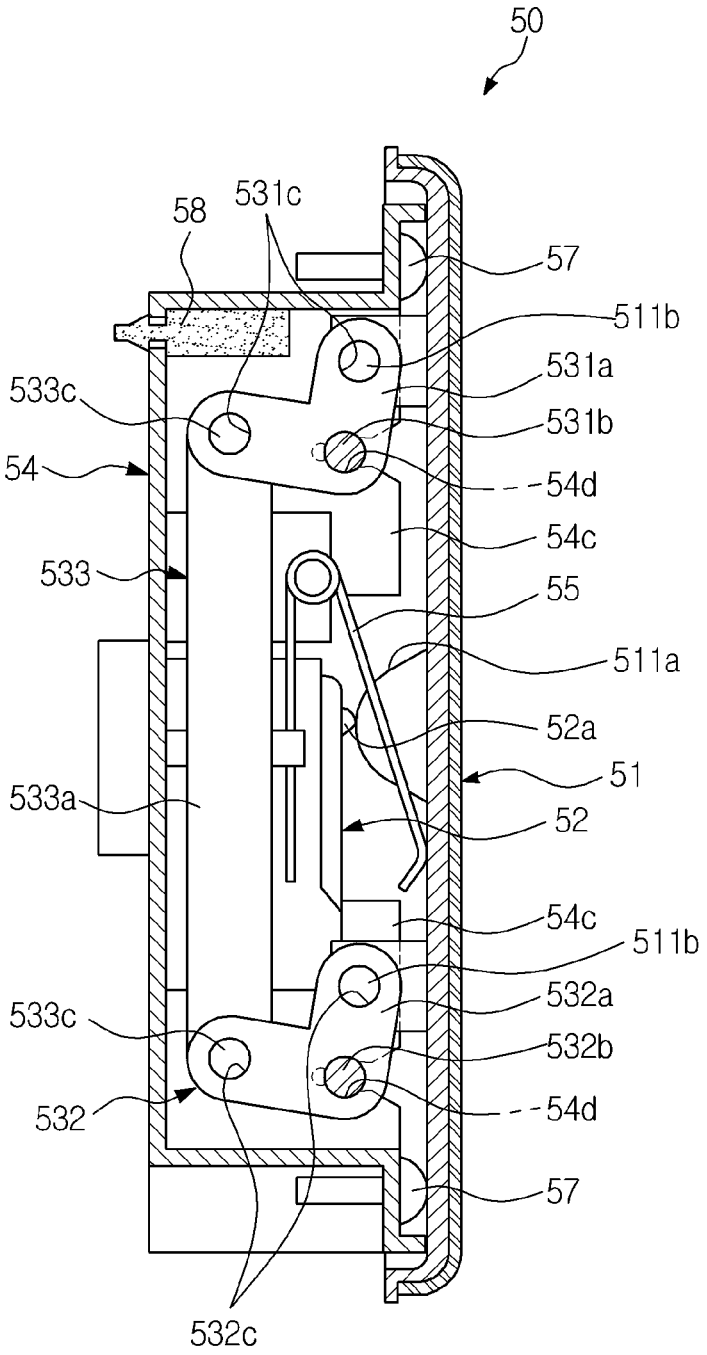

First, when a user applies external force to the push button 51 under the condition that the push button 51 has moved forwards by means of the elastic restoring force of the restoring spring 55, as shown in FIG. 5, the push button 51 moves backwards and thereby the upper link parts 531*a* and the lower link parts 532*a* are rotated in the counterclockwise direction about the upper connection shaft 531*b* and the lower connection shaft 532*b* installed in the hinge grooves 54*d*, as shown in FIG. 6. Here, the two upper link parts 531*a* are interconnected by the upper connection shaft 531*b* and thus are rotated simultaneously, and the two lower link parts 532*a* are interconnected by the lower connection shaft 532*b* and thus are rotated simultaneously. Further, the rotation of the upper link parts 531*a* and the rotation of the lower link parts 532*a* are interlocked with each other by the interlock link 533, and thus both sides of the upper portion and both sides of the lower portion of the push button 51 move backwards simultaneously. Therefore, although the external force is applied to any position of the push button 51, the backward movement of the push button 51 is uniformly carried out.

As the push button 51 move backwards, the pressure part 511*a* provided on the rear surface of the push button 51 applies pressure to the switching protrusion 52*a* of the switch 52, and thereby the dispenser 40 is operated to dispense ice.

Here, the rear surface of the push button 51 moved backwards is elastically supported by the first buffering member 57, and thus collision of the push button 51 with the switch case 54 is prevented.

When the external force applied to the push button 51 is released, the push button 61 again moves forwards by the elastic restoring force of the restoring spring, as shown in FIG. 5.

As the push button 51 moves forwards, the upper link parts 531*a* and the lower link parts 532*a* are rotated in the clockwise direction about the upper connection shaft 531*b* and the lower connection shaft 532*b*, and the interlock link parts 533*a* move upwards. Here, the second buffering members 58 are arranged above the interlock link parts 533*a*, and thus collision of the interlock link parts 533*a* with the switch case 54 is prevented.

Although this embodiment illustrates the switch module 50 installed in the discharge part 41*a* provided on the dispenser case 41, the switch module 50 is not limited thereto. Although not shown in the drawings, a discharge part may be formed by depressing a part of the front surface of a door, a dispenser may be installed above the discharge part, and then a switch module may be disposed on the front surface of the door forming the discharge part.

Further, although this embodiment illustrates the switch module 50 including the switch case 54 formed separately from the dispenser case 41 and arranged on the rear surface of the discharge part 41*a* of the dispenser case 41, the switch module 50 is not limited thereto. That is, a switch case may be formed integrally with a discharge part of a dispenser case. Further, if a discharge part is formed by depressing a part of the front surface of a door, a switch case may be formed integrally with the front surface of the door forming the discharge part.

As is apparent from the above description, in a switch module and a refrigerator having the same in accordance with one embodiment, a push button is separably installed on a switch case by a link assembly, thereby allowing internal components of the switch case to be easily repaired.

Further, external force applied to the push button is dispersed by the link assembly, and thus the push button is uniformly operated regardless of a position to which the external force is applied.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A refrigerator, comprising:

a main body provided with a storage chamber;

a door to open and close the storage chamber;

a dispenser installed on the door; and a switch module to operate the dispenser, wherein the switch module comprises:

a push button having a front surface thereof disposed in a vertical direction and moving forwards and backwards by external force, and a link assembly allowing an upper portion and a lower portion of the push button to simultaneously move forwards and backwards while maintaining the front surface of the push button to be in a vertical direction during the forward and backward movement of the push button, wherein the link assembly includes:

an upper link provided with a front end rotatably installed on an upper portion of a rear surface of the push button, a lower link provided with a front end rotatably installed on a lower portion of the rear surface of the push button, and an interlock link that is movable with respect to the rear surface of the push button and including:

an upper end of the interlock link rotatably installed on a rear end of the upper link, and a lower end of the interlock link rotatably installed on a rear end of the lower link, the interlock link configured to move the rear end of the upper link and the rear end of the lower link simultaneously up and down with respect to the rear surface of the push button as the interlock link respectively moves up and down with respect to the rear surface of the push button.

2. The refrigerator according to claim 1, further comprising a switch pressable by the push button.

3. The refrigerator according to claim 2, wherein the push button includes a pressure part protruding backwardly from the rear surface of the push button, and the switch includes a switching protrusion protruding forwardly such that pressure is applied to the switching protrusion by the pressure part upon the push button being pressed.

4. The refrigerator according to claim 1, wherein the upper link includes a pair of upper link parts provided with front ends rotatably installed at both sides of the upper portion of the rear surface of the push button and an upper connection shaft interconnecting the pair of upper link parts, the lower link includes a pair of lower link parts provided with front ends rotatably installed at both sides of the lower portion of the rear surface of the push button and a lower connection shaft interconnecting the pair of lower link parts, and the interlock link includes a pair of interlock link parts provided with upper ends rotatably installed on rear ends of the two upper link parts and lower ends rotatably installed on rear ends of the two lower link parts and an interlock connection shaft interconnecting the pair of the interlock link parts.

5. The refrigerator according to claim 4, wherein the switch module further includes a switch case provided with a front surface on which the push button is arranged, wherein the upper connection shaft and lower connection shaft are rotatably installed in the switch case.

6. The refrigerator according to claim 5, wherein the pair of upper link parts and the pair of lower link parts are formed in a V shape respectively, and both ends of the upper connection shaft are connected to the centers of the pair of the upper link parts, and both ends of the lower connection shaft are connected to the centers of the pair of the lower link parts.

7. The refrigerator according to claim 1, wherein the switch module further includes a restoring spring to elastically support the push button moved forwards.

8. The refrigerator according to claim 1, wherein the switch module further includes buffering members to elastically support the rear surface of the push button moved backwards.

9. The refrigerator according to claim 1, wherein the switch module further includes a pair of light sources to inclinedly irradiate light towards both sides of the push button in a forward direction.

10. The refrigerator according to claim 9, wherein the push button includes a transparent member made of a transparent material to transmit the light irradiated from the light sources, and an opaque member made of an opaque material and covering a front surface of the transparent member.

11. The refrigerator according to claim 1, wherein the switch module further includes a switch case provided with a front surface on which the push button is arranged, the dispenser includes a dispenser case provided with a discharge part formed at a lower portion of the dispenser case, and the switch case is arranged on a rear surface of the discharge part.

12. The refrigerator according to claim 11, wherein the switch case is formed integrally with the discharge part.

13. The refrigerator according to claim 1, wherein the switch module further includes a switch case provided with a front surface on which the push button is arranged, the door includes a discharge part formed by depressing a part of a front surface of the door, and the switch case is arranged on the front surface of the door forming the discharge part.

14. The refrigerator according to claim 13, wherein the switch case is formed integrally with the front surface of the door.

15. A refrigerator comprising:

a main body provided with a storage chamber;

a door to open and close the storage chamber;

a dispenser installed on the door; and a switch module to operate the dispenser, wherein the switch module comprises:

a push button having a front surface thereof disposed in a vertical direction and moving forwards and backwards by external force, and a link assembly allowing an upper portion and a lower portion of the push button to simultaneously move forwards and backwards while maintaining the front surface of the push button to be in a vertical direction during the forward and backward movement of the push button, wherein the link assembly includes:

an upper link including:

a front end rotatably installed on an upper portion of a rear surface of the push button, and a pair of upper link parts provided with front ends rotatably installed at both sides of the upper portion of the rear surface of the push button and an upper connection shaft interconnecting the pair of upper link parts, a lower link including:

a front end rotatably installed on a lower portion of the rear surface of the push button, and a pair of lower link parts provided with front ends rotatably installed at both sides of the lower portion of the rear surface of the push button and a lower connection shaft interconnecting the pair of lower link parts, and an interlock link including:

an upper end rotatably installed on a rear end of the upper link and a lower end rotatably installed on a rear end of the lower link, and a pair of interlock link parts provided with upper ends rotatably installed on rear ends of the two upper link parts and lower ends rotatably installed on rear ends of the two lower link parts and an interlock connection shaft interconnecting the pair of the interlock link parts, and wherein the switch module further includes buffering members installed opposite to the upper ends of the interlock link parts to elastically support the upper end of the interlock link moved upwards.

* * * * *